US005414872A

United States Patent [19]

Kessler et al.

[11] Patent Number: 5,414,872

[45] Date of Patent: May 16, 1995

[54] SOFA-BED

[75] Inventors: Stephen L. Kessler, Warsaw, Ind.; John W. Crowell, Portage, Mich.; Robert P. Fatchett, Warsaw, Ind.

[73] Assignee: Haimbaugh Enterprises, Inc., Warsaw, Ind.

[21] Appl. No.: 9,889

[22] Filed: Jan. 27, 1993

[51] Int. Cl.[6] ..... A47C 17/04

[52] U.S. Cl. ..... 5/37.1; 248/429; 397/378.13

[58] Field of Search ..... 5/37.1, 118; 248/424; 297/378.13

[56] References Cited

U.S. PATENT DOCUMENTS

| | | | |
|---|---|---|---|
| 4,089,500 | 5/1978 | Gustafsson | 248/429 |
| 4,543,675 | 10/1985 | Shrock . | |
| 4,595,164 | 6/1986 | Froutzis et al. | 248/429 |
| 4,625,346 | 12/1986 | Quackenbush | 5/37.1 |
| 4,696,069 | 9/1987 | Crosthwaite | 5/37.1 |
| 4,750,222 | 6/1988 | Quakenbush | 5/37.1 |
| 4,756,034 | 7/1988 | Stewart . | |
| 4,802,374 | 2/1989 | Hamelin et al. | 248/429 |
| 4,869,541 | 9/1989 | Wainwright | 297/378.13 |
| 5,187,820 | 2/1993 | Froutzis | 5/37.1 |
| 5,195,194 | 3/1993 | Bradley et al. | 5/37.1 |
| 5,271,109 | 12/1993 | Markel et al. | 5/37.1 |

FOREIGN PATENT DOCUMENTS

| | | | |
|---|---|---|---|
| 3643365 | 3/1988 | Germany | 248/424 |
| 235136 | 9/1988 | Japan | 248/424 |

*Primary Examiner*—Michael J. Milano
*Attorney, Agent, or Firm*—Lundy and Associates

[57] ABSTRACT

A sofa-bed which has a base with a seat member, a back member, and a bed member. The sofa-bed has linkage which connects the seat and the back and bed members together. The seat, back and bed members can be moved between a sofa position and a bed position. In the sofa position the bed member is behind the back member and in the bed position the seat, back and bed members are essentially in the same plane. The linkage connects the seat, back and bed members to the base in a slidable relation. The linkage and the seat, back and bed members can be moved together as a single unit relative to the base.

36 Claims, 3 Drawing Sheets

SOFA-BED

BACKGROUND OF THE INVENTION

The present invention pertains to convertible furniture and more particularly pertains to a sofa-bed which is particularly suitable for use in a vehicle.

Sofa-beds are pieces of furniture that are transformable into a sofa or a bed. Some sofa-beds are particularly useful secured to the floor of recreational vehicles to provide passengers both with a comfortable seat, and because of their transformability, a place to recline or sleep while traveling. The interior of these vehicles, particularly as it relates to a recreational van, provides a pair of side-by-side seats in the front and another pair of seats or a sofa behind them. Proceeding rearwardly of the vehicle interior is a sofa or sofa-bed. An access door is usually provided in the rear of the vehicle for conveniently placing items such as suit cases behind the sofa. A table, refrigerator or other accessories may be provided between the second pair of seats or sofa and the sofa-bed as desired, usually depending upon how commodious the interior.

This presents problems in that extra space is required of previous sofa beds, since the back of the sofa must move rearwardly when the sofa is transformed into a bed. In other words, the back of the sofa must be positioned an adequate distance from the rear door of the vehicle to allow for the sofa to be converted into a bed. This means that passenger leg-room or the space where refrigerators and/or other accessories are normally positioned is compromised. Thus, when considering the interior of the vehicle, one is often forced to elect between having a sofa-bed or a table, but not both in his van.

Another problem is that sofa-beds heretofore available are constructed of an indivisible seat and back mounted on a base that is secured to the floor of a vehicle like that disclosed in U.S. Pat. No. 4,543,675. Therefore, those passengers utilizing the sofa-bed must all be seated erect or must all be lying down. This is also true of the motorized seat bed disclosed in U.S. Pat. No. 4,756,034. Furthermore, these sofas cannot be moved backward and forward while they are in their respective seat and bed positions. Thus, maximum utilization of the vehicle's interior space cannot be utlized.

Lastly, because prior sofa-beds have folding and sliding parts that join the seat and the back, pulling and pushing these parts often causes them to kink and in many instances lock. This is unacceptable. An alternative sofa-bed usable in a vehicle, described in Stewart, U.S. Pat. No. 4,756,034, issued on Jul. 12, 1988, has a motorized linkage. That motorized seat bed avoids many of the kinking and locking problems, but requires its passengers all to be seated fully erect or all to be lying down and that seat bed cannot be moved backward and forward while it is in its seat or bed position.

Therefore it is highly desirable to provide an improved sofa-bed.

It is also highly desirable to provide an improved sofa-bed that can be positioned with its back and base against a wall and yet be moved between a sofa position and a bed position.

It is also highly desirable to provide an improved sofa-bed that has paricular usefullnes as a recreational vehicle allowing maximum utilization of a vehicle's interior space.

It is also highly desirable to provide an improved sofa-bed that can be moved backward and forward while it is in its respective seat or bed post ions while its base remains stationary.

It is also highly desirable to provide an improved sofa-bed that is divisible so that part of the sofa-bed can be in a seat position while at the same time another part of the sofa-bed can be in a bed position.

It is also an object of the invention to provide an improved sofa bed that is divisible so that part of the sofa-bed can be backward while at the same time another part of the sofa-bed can be forward.

It is finally highly desirable to provide an improved sofa-bed which meets all of the above desired features.

SUMMARY OF THE INVENTION

Therefore it is an object of the invention to provide an improved sofa-bed.

It is also an object of the invention to provide an improved sofa-bed that can be positioned with its back and base against a wall and yet be moved between a sofa position and a bed position.

It is also an object of the invention to provide an improved sofa-bed that has particular usefullnes in a recreational vehicle allowing maximum utilization of a vehicle's interior space.

It is also an object of the invention to provide an improved sofa-bed that can be moved backward and forward while it is in its respective seat or bed postions while its base remains stationary.

It is also an object of the invention to provide an improved sofa-bed that is divisible so that part of the sofa-bed can be in a seat position while at the same time another part of the sofa-bed can be in a bed position.

It is also an object of the invention to provide an improved sofa bed that is divisable so that part of the sofa-bed can be backward while at the same time another part of the sofa-bed can be forward.

It is finally an object of the invention to provide an improved sofa-bed which meets all of the above desired features.

In the broader aspects of the invention there is provided a sofa-bed which has a base with a seat member, a back member, and a bed member. The sofa-bed has linkage which connects the seat and the back and bed members together. The seat, back and bed members can be moved between a sofa position and a bed position. In the sofa position the bed member is behind the back member and in the bed position the seat, back and bed members are essentially in the same plane. The linkage connects the seat, back and bed members to the base in a slidable relation. The linkage and the seat, back and bed members can be moved together as a single unit relative to the base.

BRIEF DESCRIPTION OF THE DRAWINGS

The above mentioned and other features and objects of the invention and the manner of attaining them will become more apparent and the invention itself will be better understood by reference to the following description of an embodiment of the invent ion taken in conjunction with the accompanying drawings wherein.

DESCRIPTION OF A SPECIFIC EMBODIMENT

Figure 1:
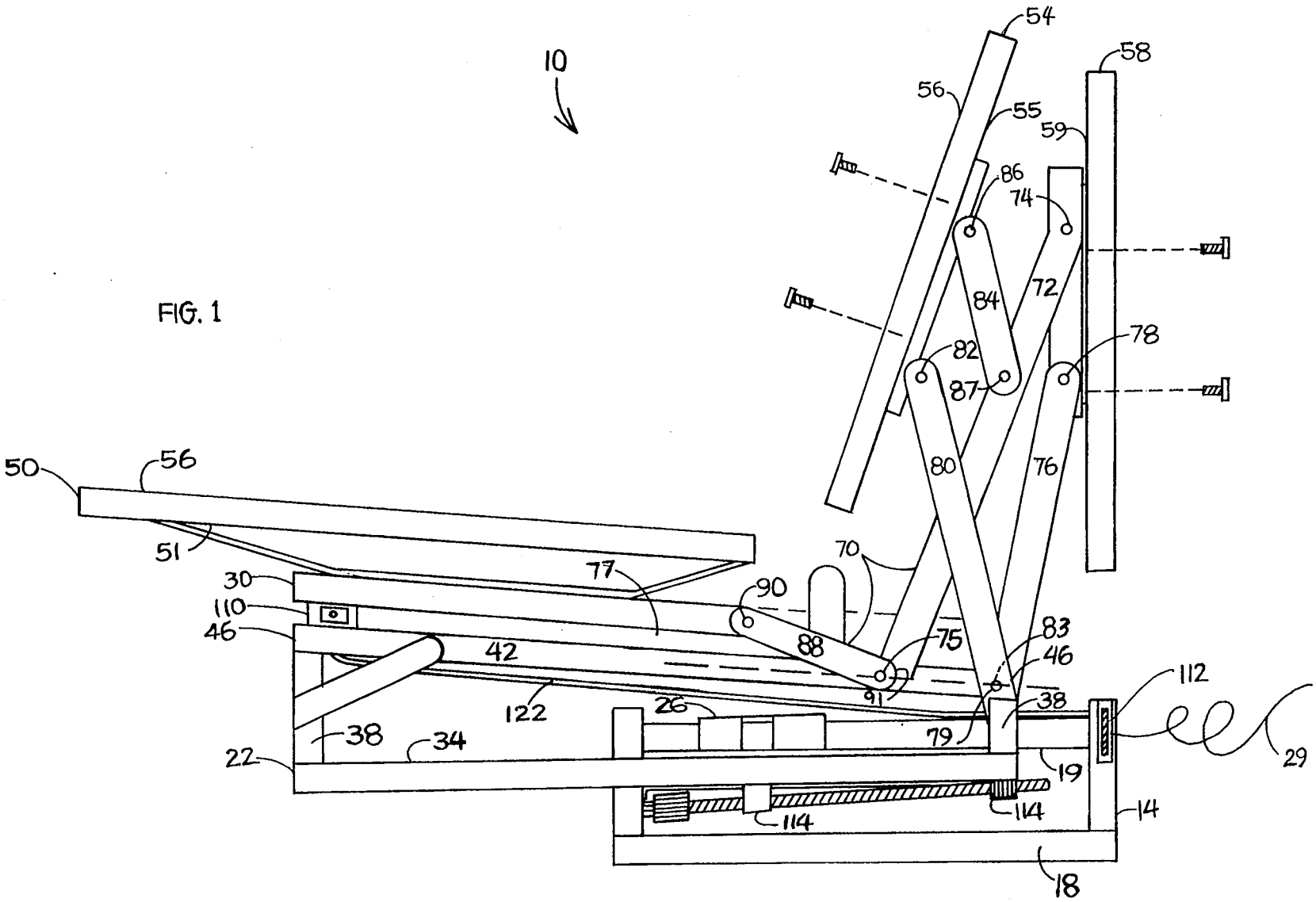
FIG. 1 is a side view of the sofa-bed of the invention in its sofa position.
Figure 3:
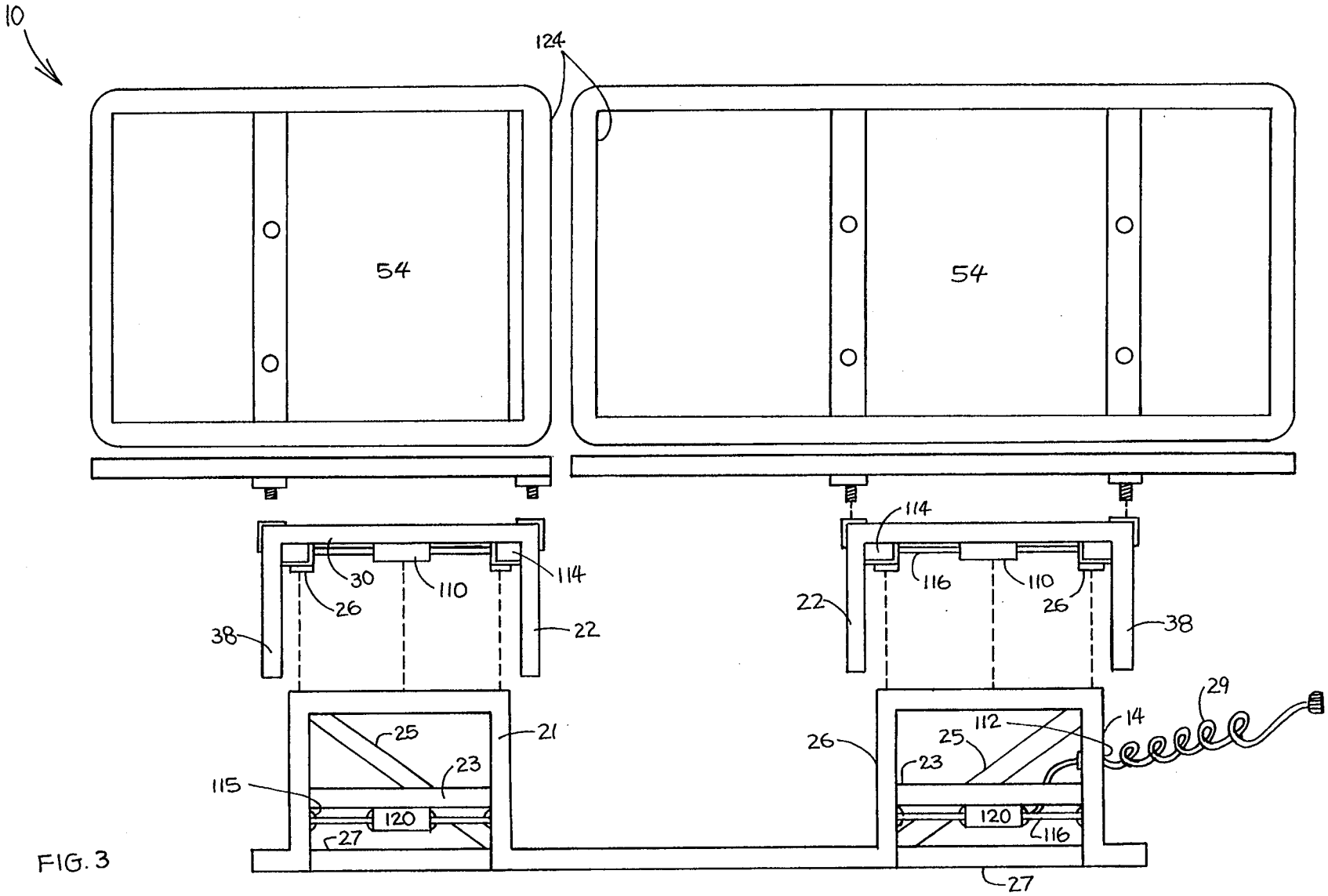
FIG. 3 is a front view of an embodiment of the sofa-bed of the invention showing the chairs and the intermediate frame disassembled from the base.

The sofa-bed 10 of the invention has base 14 with bottom members 18. Bottom members 18 are wide enough and long enough so that the horizontal movement backward and forward of the sofa-bed and unequal distribution of weight on the sofa-bed does not cause the base 14 to tilt or be lifted from its supporting surface, i.e. the floor of a vehicle. Intermediate frames 22 are supported on supports 21 above base 14 and slideably connected thereto by fasteners 26. Fasteners 26 are constructed of suitable material such as steel and partially supports intermediate frame 22 above base 14. A specific embodiment has at least rails 34 connected to intermediate frames 22 by a pair of dowwardly extending legs 38, as shown in FIGS. 1 and 3. Seat supports 30 are positioned on intermediate frames 22 and are secured thereto by a weld or some similar means.

Referring to FIGS. 1 and 3, base 14 is shown to comprise front 15 and rear 17 members separated by bottom members 18. Upper members 19 extend between front 15 and rear 17 member like bottom members 18. Members 19 extend parallel to bottom members 18. Both front 15 and rear 17 members define spaced apart supports 21 for intermediate frames 22 as shown in FIG. 3. Supports 21 are each the same and thus the description of one will suffice for the other. Supports 21 each comprise front 15 and rear 17 member separated from each other by bottom members 18 and upper members 19 and motor mount member 23. Motor mount member 23 extend parallel to bottom members 18. Each support 21 includes either slant brace 25 or bottom horizontal brace 27 or both braces 25 and 27 as illustrated. Base 14 with all of the elements shown in FIGS. 1 and 3 and either slant brace 25 or bottom brace 27 meets all of the Federal Safety Standards and are shown to provide a base 14 for sofa-bed 10 which in use will not deform from its intended shape.

Positioned on intermediate frame 22 are seat member 50, back member 54, bed member 58 and linkage 70. Seat member 50, back member 54, and bed member 58 have bottom sides 51, 55 and 59 respectively, and cushion sides 52, 56 and 60, respectively. Referring to FIG. 1, bed member 58 is in generally verticle alignment with base 14 when sofa-bed 10 is in sofa position 100. Seat member 50, back member 54, and bed member 58 are generally each frame-like structures that are woven with spring wire, belting or other similar material in order to provide resilient character when a person sits on sofa-bed 10. Cushion sides 52, 56 and 60 each have a cushion thereon, respectively, for providing sufficient padding as desired.

Linkage 70 is composed of first link 72, second link 76, third link 80, fourth link 84, fifth intermediate 1 ink 88, and intermediate frame 22 with seat support 30. A specific embodiment bas first through fifth links 72, 76, 80, 84 and 88, respectively, being made of strips of steel that are generally flat allowing links 72, 76, 80, 84 and 88 to be pivotally and/or slideably connected together and to be movable in a tong-like manner.

Referring to FIG. 1 and 3, it will be understood that linkage 70, in one embodiment is two identical sets thereof, one positioned on each side of sofa-bed 10. Like structure, therefore, will be described by using the same numerals to describe different embodiments. In a specific embodiment, linkage 70 also may be a single set of linkage positioned generally centrally of sofa-bed 10.

Linkage 70 via links 72, 76, 80, 84 and 88 connect seat member 50, back member 54, and bed member 58 together and allow them to move between a sofa position 100 and a bed position 200. Linkage 70 is pivotally and slideably connected to track guide 42. Track guide 42 has two opposite ends 46 that are secured to rail 34, as shown in FIG. 1. A specific embodiment having two identical sets of linkage 70 one positioned on each side of sofa-bed 10 has a pair of track guides 42. In that embodiment, track guides 42 with opposite ends 46 are positioned one on each side of sofa-bed 10 with opposite ends 46 secured to rail 34.

First link 72 is pivotally secured at one end to bottom side 59 of bed member 58 at first point 73 and pivotally and slideably secured at its other end to track guide 42 at a first-prime point 75. Second link 76 is pivotally secured at one end to bottom side 59 of bed member 58 at a second point 78 and pivotally secured at its other end to rail 34 at second-prime point 79. First-prime and second-prime points 75, 79 define a generally horizontal plane 77, as shown in FIG. 1, with first-prime point 75 being positioned forwardly of second-prime point 79 when sofa-bed 10 is positioned in its sofa position 100 or its bed position 200.

Third link 80 is pivotally secured at one end to bottom side 55 of back member 54 at a third point 82 and pivotally secured at its other end to rail 34 at a third-prime point 83. Second-prime point 79 and third-prime point 83 are coincident. Fourth link 84 is pivotally secured at one end to bottom side 55 of back member 54 at fourth point 86 and pivotally secured at its other end to first link 72 at fourth-prime point 87. Fifth intermediate link 88 is pivotally secured at one end to the side of seat support 30 at fifth point 90 and pivotally and slideably secured at its other end to track guide 42 at fifth-prime point 91. First-prime point 75 and fifth-prime point 91 are coincident.

Linkage 70 also connects seat member 50, back member 54 and bed member 58 to intermediate frame 22. Linkage 70, seat 50, back 54, and bed 58 members are movable on fastener 26 as a single unit relative to base 14 forward and backward both when sofa-bed 10 is in its sofa position 100 and its bed position 200.

Link 72 is longer than link 76. Link 72 is secured to bed member 58 at first point 74. Link 76 is pivotally secured to bed member 58 at second point 78. First point 74 is at a higher elevation than second point 78 when the sofa bed 10 is in its sofa position 100. Difference in lengths of said first link 72 and second link 76 is generally the same as the distance between the first point 74 and the second point 78.

Second link 76 and third link 80 are both about the same general axial length.

First link 72 is secured to bed member 58 at first point 74 and fourth link 84 is secured to back member 54 at fourth point 86. Fourth point 86 and first point 74 generally at the same elevation during the movement of the sofa bed 10 between its sofa position 100 and its bed position 200.

Fourth link 84 is pivotally secured at one end to back member 54 at fourth point 86 and pivotally secured to first link 72 at fourth prime point 87. Fourth prime point 87 is located between the opposite ends of first link 72.

A first motor 110 is secured to intermediate frame 22 and is electrically connected to switch 112. A first set of gears 114 are mechanically connected to first motor 110. First motor 110 and first set of gears 114 together must be geared sufficiently to overcome the drag forces of track guide 42 and frictional forces present in linkage 70 at pivot points 74, 75, 78, 79, 82, 83, 86, 87, 90 and 91. In the embodiment illustrated, a 30 amp motor is electrically connected to switch 112 by electrical wire 122 as shown in FIG. 1. Mechanical connections are made between first motor 110 and first set of gears 114 by cables 116. First set of gears 114 are secured to intermediate frame 22 and drive seat support 30.

Still referring to the embodiment illustrated, second motor 120 is secured to base 14. Switch 112 is electrically connected to second motor 120 by electrical wire 122 and a second set of gears 115 are positioned between bottom 18 of base 14 and intermediate frame 22. Second set of gears 115 are connected mechanically to second motor 120 by cables 116 like the cables connecting first motor 110 to first set of gears 114. Second set of gears 115 is positioned so that gears 115 move intermediate frame 22 backward and forward relative to base 14. In a specific embodiment, first and second gears 114, 115 are worm screw gears.

The specifications of first and second motors 110, 120 should be such that both are able to operate from an electrical source 29 that is part of the recreational vehicle, or that is maintained on board so that constant replacement and/or charging of existing of electrical sources is not problematic.

In all embodiments of the invention, first and second motors 110, 120 and first and second gears 114 and 115 can be eliminated from the sofa-bed 10 and the sofa-bed 10 will have all of the functionality as described herein except the movement thereof will be manual rather than elecrically powered. Latches (not shown) shall be provided to lock the sofa-bed 10 in its sofa position 100, in its bed position 200 and in its forward position and rearward positions.

Another embodiment of the invention has sofa-bed 10 consisting of a pair of chairs 124. In a specific embodiment, one chair comprises about 40 percent of sofa-bed 10 and the other chair comprises about 60 percent of sofa-bed 10. In another specific embodiment, one chair comprises about 40 percent of sofa-bed 10 and the other chair comprises about 60 percent of sofa-bed 10. In these embodiments, chairs 124 each have intermediate frames 22 supported over a single large base 14 as shown in FIG. 3. Each chair 124 has seat member 50, back member 54, bed member 58, respectively, and chairs 124 each have linkage 70, and intermediate frame 22 with at least one track guide 42 secured thereto.

Additionally, chairs 124 each have first and second motors 110, 120 with gears 114, 115, switches 112, cables 116, and electrical wire 122, respectively, as hereinabove described.

Figure 2:
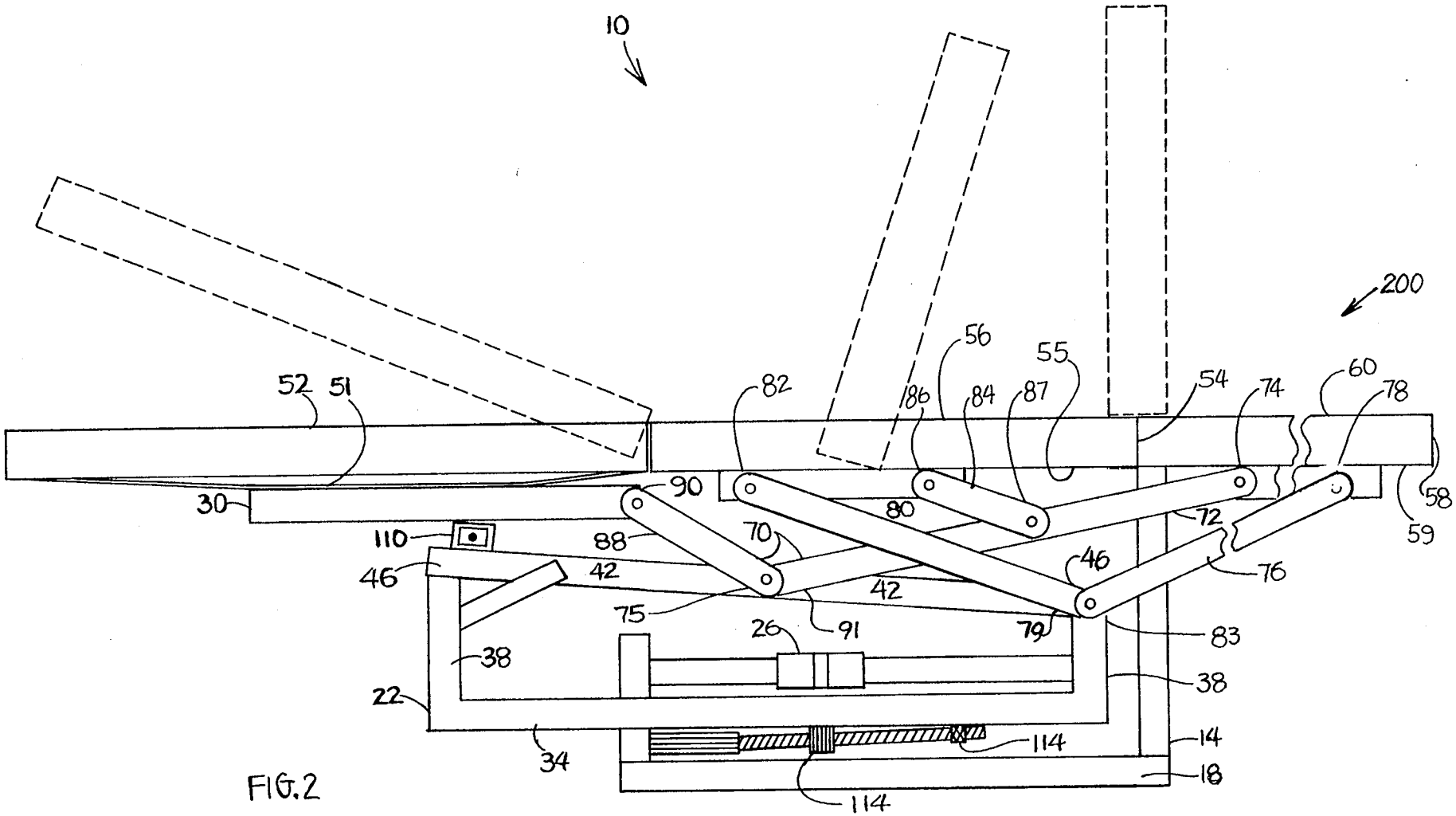
FIG. 2 is a side view like the view shown in FIG. 1 with the sofa-bed in its bed position.

Referring to FIGS. 1 through 3, sofa-bed 10 of the invention, in operation as a sofa-bed in a recreational vehicle, is positioned in a motorized vehicle and bottom 18 of base 14 is either permanently or removably secured to the floor of the vehicle. Base 14 and bed member 58 are in perfect verticle alignment so that sofa-bed 10 can be positioned against a wall of the interior of the vehicle so that the maximum utilization of the vehicle's interior space can be achieved to provide increased leg room in front of sofa-bed 10 and to add to the overall availability of interior space for tables, refrigerators, or other accessories as desired.

Each chair 124 or all of sofa-bed 10 can be moved forward by activating second motor 120. Upon activating second motor 120, second set of gears 115 engage fastener 26 and move intermediate frame 22 with seat member 50, back member 54, bed member 58 and linkage 70 thereon forward relative to base 14. This forward movement provides access to all or part of the space behind sofa-bed 10 for positioning packages, suitcases, or the like. One chair 124 of sofa-bed 10 can be in a forward position while the other chair 124 of sofa-bed 10 remains in a backward position with both positions being relative to base 14.

Likewise, one chair 124 or all of sofa-bed 10 can be moved upon activating first motor 110 into its bed position 200 as shown in FIG. 2. Upon activation of switch 112 first motor 110 causes first set of gears 114 to engage seat support 30. As seat support 30 is moved forwardly, fifth intermediate link 88 is pulled at fifth point 90 and caused to move forwardly. First link 72 is in turn caused to slide forwardly in track guide 42 at first-prime point 75. As forward motion of seat support 30 continues pivot action at pivot points 91, 90, 88, 87, 86, 84, 83, 82, 80, 79, 78, 76, 75, 74 and 72 cause a varying of the separation of seat member 50 and bed member 58 and the positioning of seat member 50 and back member 54 and bed member 58 all in essentially the same plane with back member 54 positioned between members 50 and 58 as shown in FIG. 2.

In the embodiment herein described one chair 124 of sofa-bed 10 can be positioned in bed position 200 while at the same time the other chair 124 of sofa-bed 10 can remain in sofa position 100 and either portion of sofa-bed 10 can be positioned forward or backward relative to base 14 upon activation of second motor 120 as desired.

Upon activation of switch 112, second motor 120 engages second set of gears 115 and fastener 26 is made to move forward or backward relative to base 14 as desired.

Sofa-bed 10 upon activation of switch 112 also can be repositioned in sofa position 100 as desired. Switch 112 activates first motor 110 which engages first set of gears 114 which moves seat support 30 rearwardly along with fifth intermediate link 88. Fifth intermediate link 88 is pushed at fifth point 90 and caused to move rearwardly-oppositely as above described. Similarly, first link 72 is caused to slide rearwardly in track guide 42 at first-prime point 75. As first set of gears 114 continues to move seat support 30 rearwardly pivot points 91, 90, 87, 86, 83, 82, 79, 78, 75 and 74 result in links 72, 76, 80, 84 and 88 being retracted ending with sofa-bed 10 in sofa position 100.

When sofa-bed 10 is in sofa position 100, bed member 58 is behind back member 54 and bed member 58 is in alignment with the vertical. Sofa-bed 10 may then be moved backward upon engaging second motor 120 as herein above described so that bed member 58 and base 14 are in vertical alignment. In this position, bed member 58 and base 14 can abut a wall.

Sofa bed 10 of the invention can be positioned with its back and base against a wall of a vehicle when it is in sofa position 100 thereby allowing maximum utilization of the vehicle's interior space. Sofa-bed 10 of the invention is divisible so that part of the sofa-bed 10 can be in a sofa-position while at the same time part of the sofa bed can be in a bed position. And part of the sofa-bed can be backward while at the same time part of the sofa-bed can be forward as desired. Sofa-bed 10 can be moved backward and forward while it is in its respective seat or bed positions while its base remains secured to the floor of the vehicle.

While a specific embodiment of the invention bas been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A sofa-bed comprising a base, a seat member, a back member, a bed member, and a linkage, said linkage connecting said seat member and said back member and said bed member together into a linked unit, said seat member and said back member and said bed member being movable between a sofa position with said bed member behind said back member and a bed position with said seat member and said back member and said bed member essentially in the same plane, said linkage also slideably connecting said linked unit to said base, said linked unit being movable as a single unit relative to said base independently of any movement between said seat and back and bed members.

2. The sofa-bed of claim 1 wherein said base bas a bottom, and further comprising an intermediate frame, said bottom being adapted to be secured to the floor of a vehicle, a fastener slideably securing said intermediate frame to said base, said base having a seat support, at least one rail connected to said intermediate frame by a pair of downwardly extending legs, said intermediate frame being positioned on said seat support, said intermediate frame being supported over said seat support by said legs and rail, said intermediate frame being movable backward and forward relative to said base.

3. The sofa-bed of claim 2 further comprising at least one elongated track guide with two opposite ends secured to said intermediate frame, said track guide extending front to rear of said intermediate frame, said linkage being slideably connected to said track guide.

4. The sofa-bed of claim 2 wherein said bed member and said back member and said seat member each having a bottom side and a cushion side, respectively, said linkage being secured to said bottom sides of said seat member and said back member and said bed member, respectively, said seat member and said back member and said bed member and said linkage and said intermediate frame being movable backward and forward as a single unit relative to said base.

5. The sofa-bed of claim 3 wherein said linkage includes first, second, third and fourth links, and a fifth intermediate link, said first link is pivotally secured at one end to said bottom side of said bed member at a first point and pivotally and slideably secured at its other end to said track guide at a first-prime point, said second link is pivotally secured at one end to said bottom side of said bed member at a second point and pivotally secured at its other end to said rail at a second-prime point, said first-prime and said second-prime points define a generally horizontal plane with said first-prime point being positioned forwardly of said second-prime point when said sofa-bed is in said sofa position and said bed position, said first and third links being unconnected.

6. The sofa bed of claim 5 wherein said first link is longer than said second link, and said one end of said first link is elevated above said one end of said second link when said bed member is in said sofa position.

7. The sofa bed of claim 6 wherein the difference in lengths of said first and second links is generally the same as the distance between said first and second points.

8. The sofa-bed of claim 5 wherein said third link is pivotally secured at one end to said bottom side of said back member at a third point and pivotally secured at its other end to said rail at a third-prime point, said second-prime point and said third-prime point being coincident.

9. The sofa bed of claim 8 wherein said second and third links are generally of the same length.

10. The sofa-bed of claim 5 wherein said fourth link is pivotally secured at one end to said bottom side of said back member at a fourth point and pivotally secured at its other end to said first link at a fourth-prime point.

11. The sofa bed of claim 10 wherein said one end of said first and fourth links are generally at the same elevation.

12. The sofa bed of claim 10 wherein said fourth point is located between the opposite ends of said first link.

13. The sofa-bed of claim 5 wherein said fifth intermediate link is pivotally secured at one end to said seat support at a fifth point and pivotally and slideably secured at its other end to said track guide at a fifth-prime point, and first-prime point and said fifth-prime point being coincident, thereby varying the separation of said seat member and said bed member when said sofa-bed is moved between said sofa and said bed positions.

14. The sofa-bed of claim 2 wherein said linked unit is movable backward and forward as a single unit relative to said base member.

15. The sofa-bed of claim 14 wherein the movement of said seat member and said back member and said bed member between said sofa and said bed positions is by a first motor and the movement of said unit is accomplished by a second motor.

16. The sofa-bed of claim 15 wherein said first motor includes a switch and a set of gears, said gears being adapted to move said seat member and said back member and said bed member to said sofa and said bed positions upon activation of said motor, said second motor includes a switch and a second set of gears, said gears being adapted to move said intermediate frame and said seat member and said back member and said bed member relative to said base upon activation of said second motor.

17. The sofa-bed of claim 1 wherein said sofa-bed in said sofa position is a pair of chairs each having its own seat member and back member and bed member, respectively, said chairs being side by side, said chairs each having its own linkage and its own intermediate frame with at least one track guide secured thereto, and a base, said seat members and said back members and said bed members and said linkages being independently movable backward and forward as a single unit respectively relative to said base.

18. The sofa-bed of claim 17 wherein one of said pair of chairs comprises about sixty percent of the length of said sofa and the other of said pair of chairs comprises about forty percent of the length of said sofa.

19. A sofa-bed comprising a base, a seat member, a back member, a bed member, and a pair of oppositely disposed linkages, said linkages connecting said seat member and said back member and said bed member together into a linked unit, said seat member and said back member and said bed member being movable between a sofa position with said bed member behind said back member and a bed position with said seat member and said back member and said bed member essentially in the same plane, said linkages also slideably connecting said linked unit to said base, said linkages varying the separation of said seat member and said bed member as said members are moved between said sofa and bed positions, said bed member in said sofa position generally defining a vertical plane, said linked unit being movable as a single unit relative to said base independently of any movement between said seat and back and bed members.

20. The sofa-bed of claim 19 wherein said base has a bottom, and further comprising an intermediate frame, said bottom being adapted to be secured to the floor of a vehicle, a fastener slideably securing said intermediate frame to said base, said base having a seat support, a pair of opposite side rails connected to said intermediate frame by two pairs of oppositely disposed downwardly extending legs, said intermediate frame being positioned on said seat support, said intermediate frame being supported over said seat support by said legs, said intermediate frame being movable backward and forward relative to said base.

21. The sofa-bed of claim 20 further comprising a pair of elongated track guides with two opposite ends respectively, said track guides being secured to said intermediate frame respectively, said track guides extending front to rear of said intermediate frame, said linkages being slideably connected to said track guides, respectively.

22. The sofa-bed of claim 20 wherein said bed member and said back member and said seat member each having a bottom side and a cushion side, respectively, said linkages being secured to said bottom sides of said seat member and said back member and said bed member, respectively, said seat member and said back member and said bed member and said linkages and said intermediate frame being movable backward and forward as a single unit relative to said base.

23. The sofa-bed of claim 21 wherein said linkages each have a first, second, third and fourth links, and a fifth intermediate link, said first links are pivotally secured at one end to said bottom side of said bed member at first points and pivotally and slideably secured at their other end to said track guide at first-prime points, respectively, said second links are pivotally secured at one end to said bottom side of said bed member at second points and pivotally secured at their other end to said side rails at second-prime points, respectively, said first-prime and said second-prime points respectively define a generally horizontal plane with said first-prime points being positioned forwardly of said second-prime points when said sofa-bed is in said sofa position and in said bed position, said first and third links being connected.

24. The sofa bed of claim 23 wherein said first link is longer than said second link, and said one end of said first link is elevated above said one end of said second link when said bed member is in said sofa position.

25. The sofa bed of claim 24 wherein the difference in lengths of said first and second links is generally the same as the distance between said first and second points.

26. The sofa-bed of claim 23 wherein said third links are pivotally secured at one end to said bottom side of said back member at third points and pivotally secured at their other end to said side rails at third-prime points, respectively, said second-prime points and said third-prime points being respectively coincident.

27. The sofa bed of claim 26 wherein said second and third links are generally of the same length.

28. The sofa-bed of claim 21 wherein said fourth links are pivotally secured at one end to said bottom side of said back member at fourth points and pivotally secured at their other end to said first link at fourth-prime points, respectively.

29. The sofa bed of claim 28 wherein said one end of said first and fourth links are generally at the same elevation.

30. The sofa bed of claim 28 wherein said fourth pivot point is located between the opposite ends of said first link.

31. The sofa-bed of claim 23 wherein said fifth intermediate links are pivotally secured at one end to said seat support at fifth points and pivotally and slideably secured at their other end to said track guides at fifth-prime points, respectively, said first-prime points and said fifth-prime points being respectively coincident, thereby varying the separation of said seat member and said bed member when said sofa-bed is moved between said sofa and said bed positions.

32. The sofa-bed of claim 20 wherein said linked unit is movable backward and forward as a single unit relative to said base member.

33. The sofa-bed of claim 32 wherein the movement of said seat member and said back member and said bed member between said sofa and bed positions is by a first motor and the movement of said unit is accomplished by a second motor.

34. The sofa-bed of claim 33 wherein said first motor includes a switch and a set of gears, said gears being adapted to move said seat member and said back member and said bed member to said sofa and said bed positions upon activation of said motor, said second motor includes a switch and a second set of gears, said gears being adapted to move said seat member and said back member and said bed member relative to said base upon activation of said second motor.

35. The sofa-bed of claim 19 wherein said sofa-bed in said sofa position is a pair of chairs each having its own seat member and back member and bed member, respectively, said chairs being side by side, said chairs each having its own pair of linkages and its own intermediate frame with a pair of track guides secured thereto, and a base, said seat members and said back members and said bed members and said linkages being independently movable backward and forward as a single unit respectively relative to said respective bases.

36. The sofa-bed of claim 35 wherein one of said pair of chairs comprises about sixty percent of the length of said sofa and the other of said pair of chairs comprises about forty percent of the length of said sofa.

* * * * *